US009024168B2

(12) United States Patent
Peterson

(10) Patent No.: US 9,024,168 B2
(45) Date of Patent: May 5, 2015

(54) ELECTRONIC MUSICAL INSTRUMENT

(71) Applicant: Todd A. Peterson, Minneapolis, MN (US)

(72) Inventor: Todd A. Peterson, Minneapolis, MN (US)

( * ) Notice: Subject to any disclaimer, the term of this patent is extended or adjusted under 35 U.S.C. 154(b) by 0 days.

(21) Appl. No.: 14/188,726

(22) Filed: Feb. 25, 2014

(65) Prior Publication Data

US 2014/0251116 A1 Sep. 11, 2014

Related U.S. Application Data

(60) Provisional application No. 61/772,801, filed on Mar. 5, 2013.

(51) Int. Cl.

| | |
|---|---|
| ***G10H 1/18*** | (2006.01) |
| ***G10H 1/20*** | (2006.01) |
| ***G10H 1/00*** | (2006.01) |
| ***G10H 1/055*** | (2006.01) |

(52) U.S. Cl.

CPC ..... *G10H 1/20* (2013.01); *G10H 1/0008* (2013.01); *G10H 1/0066* (2013.01); *G10H 1/18* (2013.01); *G10H 1/0558* (2013.01); *G10H 2220/241* (2013.01)

(58) Field of Classification Search

USPC ..... 84/615, 653
IPC ..... G10H 1/18,1/20
See application file for complete search history.

(56) References Cited

U.S. PATENT DOCUMENTS

| | | | | |
|---|---|---|---|---|
| 3,663,735 | A * | 5/1972 | Evans | 84/721 |
| 4,342,244 | A | 8/1982 | Perkins | |
| 4,423,654 | A * | 1/1984 | Yamagami | 84/726 |
| 5,140,887 | A | 8/1992 | Chapman | |
| 5,140,888 | A | 8/1992 | Ito | |
| 5,245,130 | A * | 9/1993 | Wheaton | 84/742 |
| 5,276,272 | A | 1/1994 | Masuda | |
| D349,127 | S | 7/1994 | Nelson | |
| 5,398,585 | A | 3/1995 | Starr | |
| 5,488,196 | A | 1/1996 | Zimmerman et al. | |
| 6,005,181 | A * | 12/1999 | Adams et al. | 84/734 |

(Continued)

FOREIGN PATENT DOCUMENTS

| | | |
|---|---|---|
| EP | 1183677 B1 | 3/2002 |
| EP | 1274069 B1 | 1/2003 |

(Continued)

OTHER PUBLICATIONS

Yunik et al., "A Microprocessor Based Digital Flute," International Computer Music Conference Proceedings, 1983, pp. 127-136, Ann Arbor, MI: MPublishing, University of Michigan Library.

*Primary Examiner* — David Warren
(74) *Attorney, Agent, or Firm* — Koziol IP PLLC

(57) ABSTRACT

An electronic musical instrument includes a plurality of touch sensors each configured to generate an electrical signal representative of a musical note in response to being touched by a user, one or more proximity sensors each configured to generate an electrical signal representative of a musical key based on a distance between the user and the sensor, a controller configured to generate electrical signals representative of sound based on the electrical signals from the plurality of touch sensors and one or more proximity sensors, and one or more transducers configured to generate sound based on the electrical signals generated by the controller.

20 Claims, 5 Drawing Sheets

(56) References Cited

U.S. PATENT DOCUMENTS

| | | | | |
|---|---|---|---|---|
| 6,018,118 | A * | 1/2000 | Smith et al. | 84/600 |
| 7,723,605 | B2 | 5/2010 | Gremo et al. | |
| 7,829,780 | B2 * | 11/2010 | Onozawa | 84/732 |
| 8,093,486 | B2 | 1/2012 | Behringer et al. | |
| 8,222,507 | B1 * | 7/2012 | Salazar et al. | 84/602 |
| 8,299,347 | B2 | 10/2012 | Johnson | |
| 8,607,651 | B2 * | 12/2013 | Eventoff | 73/862.627 |
| 8,847,757 | B2 * | 9/2014 | Kim et al. | 340/556 |
| 2002/0134223 | A1 * | 9/2002 | Wesley | 84/719 |
| 2003/0066414 | A1 * | 4/2003 | Jameson | 84/741 |
| 2005/0246459 | A1 * | 11/2005 | Philipp | 710/67 |
| 2007/0017352 | A1 * | 1/2007 | Masuda | 84/658 |
| 2007/0240560 | A1 * | 10/2007 | Plamondon | 84/744 |
| 2007/0261540 | A1 * | 11/2007 | Gremo et al. | 84/743 |
| 2008/0028920 | A1 * | 2/2008 | Sullivan | 84/722 |
| 2008/0072738 | A1 | 3/2008 | Plamondon et al. | |
| 2008/0271594 | A1 | 11/2008 | Starr | |
| 2008/0314226 | A1 * | 12/2008 | Shibata | 84/384 |
| 2009/0288548 | A1 * | 11/2009 | Murphy et al. | 84/645 |
| 2009/0291756 | A1 * | 11/2009 | McCauley et al. | 463/31 |
| 2010/0037755 | A1 * | 2/2010 | McMillen et al. | 84/645 |
| 2010/0313736 | A1 * | 12/2010 | Lenz | 84/477 R |
| 2011/0041672 | A1 | 2/2011 | Chan et al. | |
| 2011/0088535 | A1 | 4/2011 | Zarimis | |
| 2011/0273700 | A1 * | 11/2011 | Lambert et al. | 356/28 |
| 2011/0283334 | A1 * | 11/2011 | Choi et al. | 725/148 |
| 2013/0138233 | A1 * | 5/2013 | Sandler et al. | 700/94 |
| 2013/0180384 | A1 * | 7/2013 | Van Wagoner et al. | 84/485 R |
| 2013/0205978 | A1 * | 8/2013 | Yamabata | 84/616 |
| 2014/0004908 | A1 * | 1/2014 | Park et al. | 455/566 |
| 2014/0090547 | A1 * | 4/2014 | Udell, III | 84/626 |
| 2014/0215398 | A1 * | 7/2014 | Fleizach et al. | 715/823 |
| 2014/0251116 | A1 * | 9/2014 | Peterson | 84/645 |
| 2014/0267123 | A1 * | 9/2014 | Ludwig | 345/173 |
| 2014/0283670 | A1 * | 9/2014 | Eventoff | 84/723 |

FOREIGN PATENT DOCUMENTS

| | | | |
|---|---|---|---|
| EP | 2092512 | B1 | 6/2011 |
| WO | WO2009096762 | A2 | 8/2009 |
| WO | WO2012098278 | A1 | 7/2012 |

* cited by examiner

ELECTRONIC MUSICAL INSTRUMENT

CROSS-REFERENCE TO RELATED APPLICATIONS

This application claims the benefit of Application No. 61/772,801, filed Mar. 5, 2013, which is incorporated herein by reference in its entirety.

TECHNICAL FIELD

The present invention relates to musical instruments. More specifically, the present invention relates to an electronic musical instrument including touch and proximity sensors configured to control the musical notes and/or musical keys output by the musical instrument.

BACKGROUND

The creativity of musicians is enhanced through new musical instruments. Low-cost mass-market computing has brought an explosion of new musical creativity through electronic and computerized instruments. The human-computer interface with such instruments is key. The widely accepted Musical Instrument Digital Interface (MIDI) standard provides a common way for various electronic instruments to be controlled by a variety of human interfaces.

MIDI is a standard protocol that allows electronic musical instruments, computers and other electronic devices to communicate and synchronize with each other. MIDI does not transmit an audio signal. Instead it sends event messages about pitch and intensity, control signals for parameters such as volume, vibrato and panning, and clock signals in order to set a tempo. MIDI is an electronic protocol that has been recognized as a standard in the music industry since the 1980s.

All MIDI compatible controllers, musical instruments, and MIDI compatible software follow the standard MIDI specification and interpret any MIDI message in the same way. If a note is played on a MIDI controller, it will sound the right pitch on any MIDI-capable instrument.

SUMMARY

In one aspect, the present disclosure relates to an electronic musical instrument including a plurality of touch sensors each configured to generate an electrical signal representative of a musical note in response to being touched by a user. The electronic musical instrument also includes one or more proximity sensors each configured to generate an electrical signal representative of a musical key based on a distance between the user and the sensor. A controller is configured to generate electrical signals representative of sound based on the electrical signals from the plurality of touch sensors and one or more proximity sensors, and one or more transducers are configured to generate sound based on the electrical signals generated by the controller.

In some embodiments, the plurality of touch sensors are configured to generate an electrical signal representative of a musical pitch or chord in response to two or more of the plurality of touch sensors being touched simultaneously. In some embodiments, the plurality of touch sensors are arranged in a matrix on a body of the electronic musical instrument. In some embodiments, the one or more proximity sensors comprise optical sensors. In some embodiments, the electronic musical instrument further comprises a synthesizer control panel. The electronic musical instrument can further include a display configured to identify the musical key based on signals from the one or more proximity sensors. The electronic musical instrument can further include a microphone configured to generate electrical signals representative of user breath strength, wherein the controller is configured to control an amplitude of the electrical signals representative of sound based on the electrical signals representative of user breath strength. In some embodiments, the electronic musical instrument further includes a communications port configured to connect the controller to an external device. In various embodiments, the electronic musical instrument is configured as a guitar, wind instrument, keyboard, lute, or drum.

In another aspect, the present disclosure relates to an electronic musical system including an electronic musical instrument, one or more transducers, and a computer. The electronic musical instrument includes a plurality of touch sensors each configured to generate an electrical signal representative of a musical note in response to being touched by a user and one or more proximity sensors each configured to generate an electrical signal representative of a musical key based on a distance between the user and the sensor. The electronic musical instrument further includes a controller configured to generate electrical signals representative of sound based on the electrical signals from the plurality of touch sensors and one or more proximity sensors. The one or more transducers are configured to generate sound based on the electrical signals generated by the controller. The computer is coupled to the controller and comprises a digital audio workstation configured to provide a graphical user interface to facilitate recording, playback, and editing of music from the electronic musical instrument.

In some embodiments, the electronic musical system further includes a musical instrument digital interface (MIDI) connected to the controller and configured to interpret the electrical signals representative of sound, and a synthesizer configured to generate input signals to the one or more transducers based on the electrical signals interpreted by the MIDI. The electronic musical system can also include a synthesizer control panel configured to control settings of the synthesizer. In some embodiments, the synthesizer control panel is disposed on the electronic musical instrument. In some embodiments, each of the touch sensors and proximity sensors is connected to a MIDI controller. In some embodiments, the electronic musical system further includes a device hub coupled between the controller and computer, wherein the device hub is configured to couple a plurality of electronic musical instruments to the computer.

While multiple embodiments are disclosed, still other embodiments of the present invention will become apparent to those skilled in the art from the following detailed description, which shows and describes illustrative embodiments of the invention. Accordingly, the drawings and detailed description are to be regarded as illustrative in nature and not restrictive.

Figure 1:
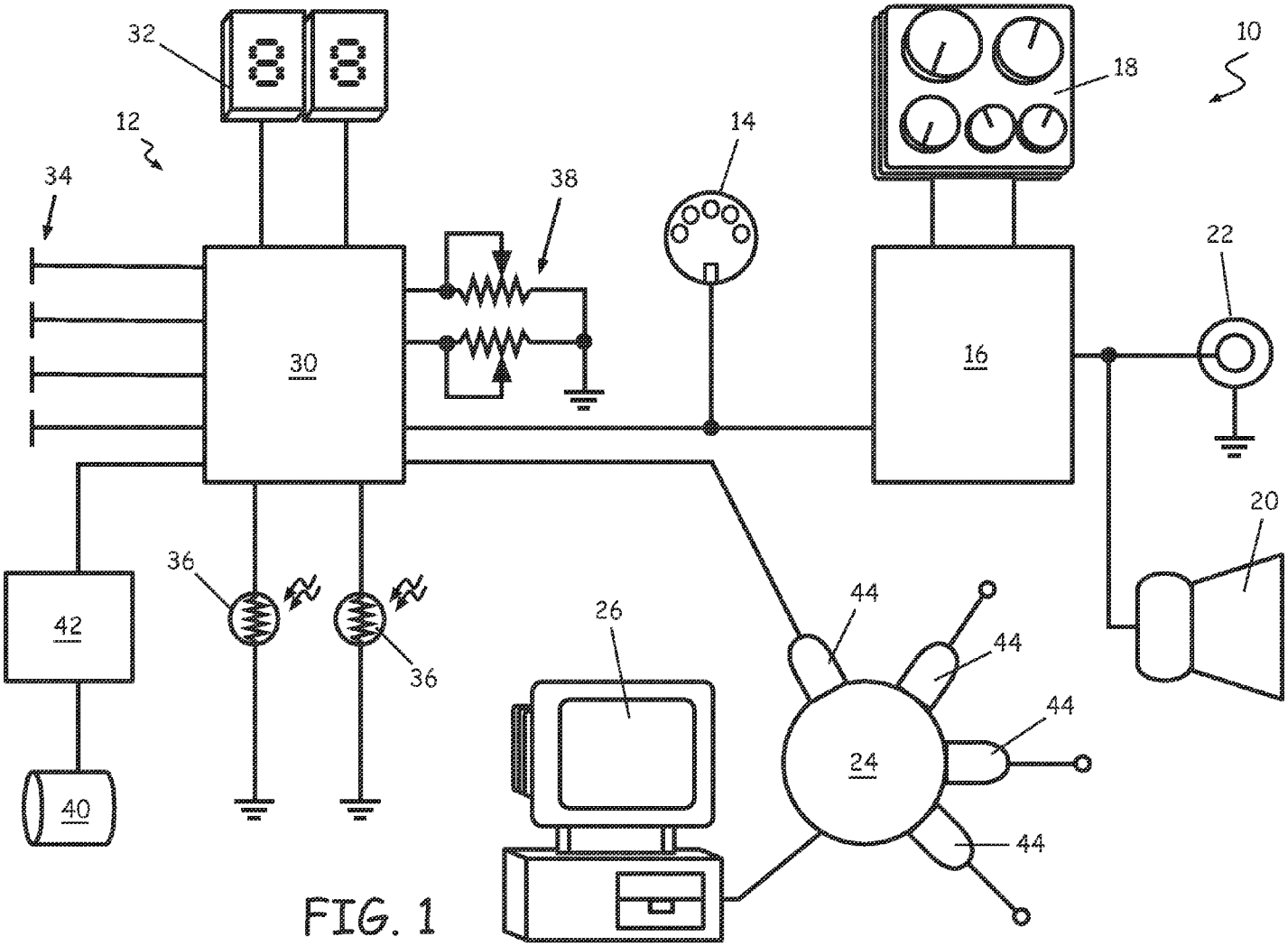
FIG. 1 is a diagram of an electronic musical instrument and associated electronic musical system according to an embodiment of the present disclosure.

While the invention is amenable to various modifications and alternative forms, specific embodiments have been shown by way of example in the drawings and are described in detail below. The intention, however, is not to limit the invention to the particular embodiments described. On the contrary, the invention is intended to cover all modifications, equivalents, and alternatives falling within the scope of the invention as defined by the appended claims.

DETAILED DESCRIPTION

FIG. 1 is a diagram of an electronic musical system 10 according to an embodiment of the present disclosure. The electronic musical system 10 includes an embodiment of an electronic musical instrument 12, a musical instrument digital interface (MIDI) 14, a synthesizer 16, a synthesizer control panel 18, an audio transducer 20, an audio auxiliary port 22, a device hub 24, and a computer 26. The electronic musical instrument 12 includes a controller 30, digital display 32, touch sensors 34, proximity sensors 36, and instrument adjustment elements 38. In some embodiments, the electronic musical instrument 12 further includes a microphone 40 and breath strength circuit 42. While shown as separate elements, some or all of the elements shown in FIG. 1 can be integrated into a single device.

The controller 30 receives signals from the touch sensors 34, proximity sensors 36, adjustment elements 38, and breath strength circuit 42. The signals provided by these elements are used to determine the sounds that are generated by the electronic musical instrument 12. The controller 30 provides output signals to the digital display 32, and to the output connected to the MIDI 14 and the synthesizer 16. The synthesizer 16 is connected to the synthesizer control panel 18 and provides output signals to the audio transducer 20 and audio auxiliary port 22. The controller 30 of the electronic musical instrument 12 interfaces with the computer 26 via the device hub 24. The device hub 24 includes a plurality of input ports 44 that allow a plurality of electronic musical instruments to interface with the computer 26.

The touch sensors 34 are configured to generate an electrical signal when touched by a user of the electronic musical instrument 12. The touch sensors 34 operate as the keys, strings, etc. of the electronic musical instrument 12 without the mechanical movement or vibration associated with these conventional components. In some embodiments, the touch sensors 34 are capacitance touch switches, in which body capacitance of the user varies the capacitance of the touch sensor(s) 34 being touched. The difference in capacitance when each touch sensor 34 touched is processed by the controller 30. The controller 30 generates a signal indicative of a musical note or combination of notes, depending on the touch sensors 34 touched by the user. In one alternative embodiment, the touch sensors 34 are resistive touch sensors, which generates an electrical response when the user contacts two or more electrodes integrated in a touch sensor 34 to generate a change in resistance. In another alternative embodiment, the touch sensors 34 are piezo touch switches, which each generate electrical signal when the user bends or deforms the touch sensor 34 when touching the sensor. While four touch sensors 34 are shown in FIG. 1, in actual implementation of the electronic musical instrument 12, the instrument can include fewer or more touch sensors 34.

The proximity sensors 36 are configured to generate electrical signals that are dependent on the proximity of an object, such as the user's hand or finger, to the sensor. The proximity sensors 36 can generate different electrical signals for different levels of object proximity. In some embodiments, the signals generated by the proximity sensors 36 can be used by the controller 30 to set a musical key at which the touch sensors 34 operate. In other words, the signals from the proximity sensors 36 can be used to transpose the notes or tones played by the touch sensors 34. In some embodiments, the proximity sensors 36 are light-dependent resistors (LDRs), or photoresistors, which has a resistance that varies depending on the amount of incident light sensed by the LDRs. The resistance of each of the LDRs can then be converted by the controller 30 to an output associated with the operation of the electronic musical instrument 12. In alternative embodiments, the proximity sensors 36 can comprise other types of proximity sensors, such as capacitive displacement sensors, Doppler effect sensors, eddy current sensors, inductive sensors, laser rangefinder sensors, magnetic sensors, passive optical sensors, passive thermal infrared sensors, photocells, sonar sensors, and/or ultrasonic sensors.

The adjustment elements 38 allow the user to adjust various settings of the electronic musical instrument. For example, the adjustment elements 38 can be used to adjust the tone generated when each of the touch sensors 34 is touched (i.e., tuning). As another example, the adjustment elements 38 can be used to control operational characteristics of the electronic musical instrument 12, such as the sensitivity of the touch sensors 34 and proximity sensors 36, or to manually adjust settings of the electronic musical instrument 12, such as key or volume. In some embodiments, the adjustment elements 38 are variable resistors that are adjustable with a device such as a knob or slide on the instrument 12.

The digital display 32 provides information about one or more settings of the electronic musical instrument. For example, in some embodiments, the digital display 32 is controlled by the controller 30 to display the current musical key of the touch sensors 34. As another example, in some embodiments, the digital display 32 is controlled by the controller 30 to display the current volume of the electronic musical instrument 12. While two seven segment displays are shown, the digital display 32 can alternatively include any number and type of digital display (e.g., liquid crystal display, light emitting diode display, front lit display, back lit display, etc.).

The microphone 40 is provided on embodiments of the electronic musical instrument 12 that includes wind as an input (e.g., clarinet, trumpet, saxophone, etc.). The microphone 40 receives breath inputs from the user and provides electronic signals to the breath circuit 42. The breath circuit 42 calculates the intensity of the breath input from the user based on the amplitude of the signal from the microphone 40. That is, a low amplitude signal from the microphone 40 indicates that the user is blowing softly into the electronic musical instrument 12, while a high amplitude signal from the microphone 40 indicates that the user is blowing strongly into the electronic musical instrument 12. The controller 30 receives the amplitude signal from the breath circuit 42 and controls the output volume of the electronic musical instrument 12 based on the amplitude. In alternative embodiments, the controller 30 processes the signals from the microphone 40 to determine the volume of the MIDI notes.

The controller 30 controls operation of the electronic musical instrument 12. In some embodiments, the controller 30 is a part of an Arduino, Microchip PIC, Basic Stamp, or Cypress PSoC Pioneer, although other suitable controllers can alternatively be used. When the electronic musical instrument 12 is activated, the controller 30 initiates by calibrating the touch sensors 34 and proximity sensors 36. The controller 30 then determines whether the proximity sensors 36 are within range limits when the user moves his or her hand over the proximity sensors 36. For example, if the proximity sensors 36 are photoresistors, the controller 30 determines whether there is sufficient ambient light to detect variations in light as the user moves his or her hand various distances from the sensors 36. If not, the controller 30 continually checks the sensors 36 until the detected movement over the sensors is within range limits. When within range limits, the controller 30 sets minimum and maximum values for the parameter detected by the proximity sensors 36. For example, the controller 30 can set the minimum value for a photoresistor proximity sensor 36 when the sensor is covered and a maximum value for the photoresistor proximity sensor 36 when the photoresistor is completely uncovered. The controller 30 can then set the value ranges between the minimum and maximum value that correspond to various musical keys. For example, for a photoresistor, different ranges of luminous flux detected by the photoresistor (and thus, different resistances detected by the controller 30) can each correspond to a different musical key. The controller 30 can then cause the electronic musical instrument 12 to indicate that it is ready for use (e.g., indicator on the digital display 32).

The controller 30 then determines whether the user has made any adjustments to the settings of the electronic musical instrument 12 with the adjustment elements 38. After processing any adjustments, the controller 30 checks the proximity sensors 36 to determine whether the user has changed the musical key of the electronic musical instrument 12 by placing his or her hand in proximity to the sensors 36. When the controller 30 has changed the musical key per the user's position with respect to the sensors 36, the controller 30 then detects whether the user is touching any of the touch sensors 34. If the touch sensors 34 are not being touched, the controller 30 returns to determining whether the user has made any adjustments to the settings of the electronic musical instrument. If any of the touch sensors are being touched, the controller 30 generates an output signal to the MIDI 14 and synthesizer 16 that corresponds to the musical note associated with the touch sensor(s) 34 touched by the user. The controller 30 can alternatively be configured to monitor the adjustment elements 38, touch sensors 34, and proximity sensors 36 simultaneously for user interaction.

The electronic musical instrument 12 includes one or more output ports connected to the controller 30 for connection to other devices or systems. For example, in some embodiments, the electronic musical instrument 12 includes one or more universal serial bus (USB) ports. The electronic musical instrument 12 can interface with the device hub 24 by connecting a cable between one of the output ports and an input port 44 on the device hub 24. In the embodiment shown, the device hub 24 is connected to the computer 26. The computer 26 can include software that provides a digital audio workstation (DAW) to allow recording, editing, and playback of music created with the electronic musical instrument 12.

The electronic musical instrument 12 can also be connected to the MIDI 14 via an output port on the electronic musical instrument 12. In some embodiments, the electronic musical instrument 12 includes a MIDI port or USB port that is connectable to the MIDI 14 via an appropriate cable. The MIDI 14 carries event messages that specify, for example, notation, pitch and velocity, and control signals for parameters such as volume and vibrato. The messages are provided to the synthesizer 16, which controls sound generation from the MIDI messages. For example, the MIDI 14 can generate a Standard MIDI File that is interpretable by the synthesizer 16.

The synthesizer 16 is employed to generate sounds that imitate the conventional instrument that the electronic musical instrument 12 represents. The synthesizer 16 can employ a variety of waveform synthesis techniques to generate the desired signal, including, but not limited to, the most popular waveform synthesis techniques are subtractive synthesis, additive synthesis, wavetable synthesis, frequency modulation synthesis, phase distortion synthesis, physical modeling synthesis and sample-based synthesis. The settings of the synthesizer 16, such as audio effects and characteristics (e.g., attack, decay, sustain, release, etc.), can be controlled with the synthesizer control panel 18.

The synthesizer 16 can include one or more output ports to connect with devices that produce sound from the signals output from the synthesizer 16. The synthesizer 16 can be connected to an audio transducer 20 (i.e., speaker) that is capable of reproducing audio within the frequency ranges generated by synthesizer 16. The synthesizer 16 can also include an audio auxiliary port 22 that allows the synthesizer 16 to be coupled to other types of audio systems.

Figure 2:
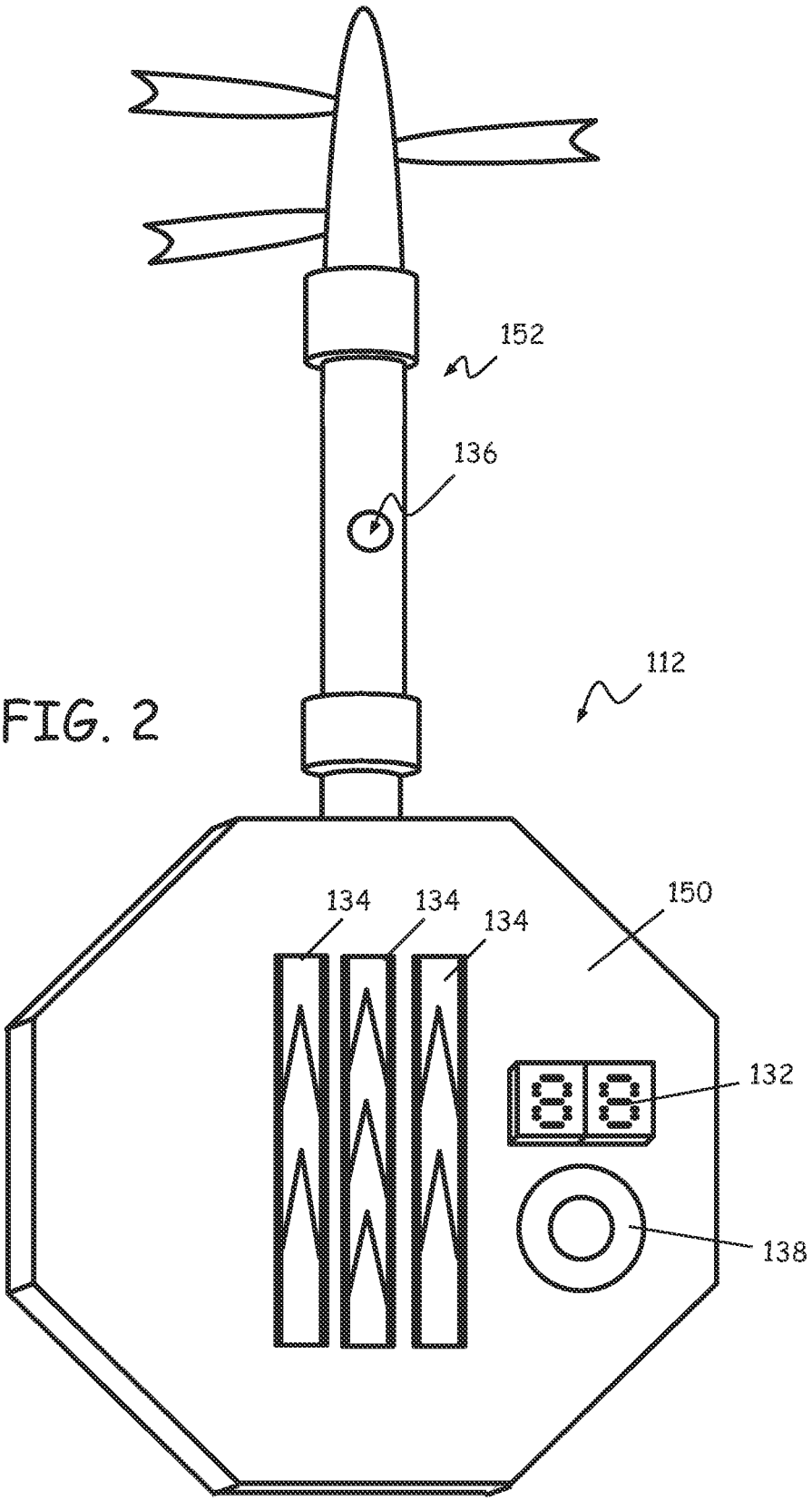
FIG. 2 is a plan view of an embodiment of an electronic lute or guitar according to the present disclosure.

FIGS. 2-5 illustrate various embodiments of the electronic musical instrument 12 described with regard to FIG. 1. Each of the following musical instruments are merely illustrative, and it is contemplated that the electronic musical instrument 12 can take on other forms. FIG. 2 is a plan view of an embodiment of an electronic lute or guitar 112 according to the present disclosure. The electronic lute 112 includes a plurality of touch sensors 134 located on the body 150 of the lute 112, and a proximity sensor 136 located on the neck 152 of the lute 112. While the lute 112 is shown including three touch sensors 134 and one proximity sensor 136, any number of touch and proximity sensors can be included on the lute 112. Also, while the touch sensors 134 are shown as elongate elements extending in parallel to each other, the sensors 134 can alternatively have other configurations, such as hexagonal sensors arranged in a honeycomb pattern (see FIG. 4, for example). The touch sensors 134 can be touched individually or simultaneously to produce different notes or combinations of notes associated with each of the touch sensors 134. The user can control the notes played by the touch sensors 134 by moving his or her hand or finger relative to the proximity sensor 136. In some embodiments, the lute 112 also includes a scroll wheel 138 and/or a digital display 132 on the body 150. The scroll wheel 138 can be used, for example, to control the volume of the lute 112. The digital display 132 can be used to display the volume level or current musical key, for example. The MIDI 14 and synthesizer 16 are provided signals by the lute 112 to generate sounds to imitate a conventional lute or guitar.

Figure 3:
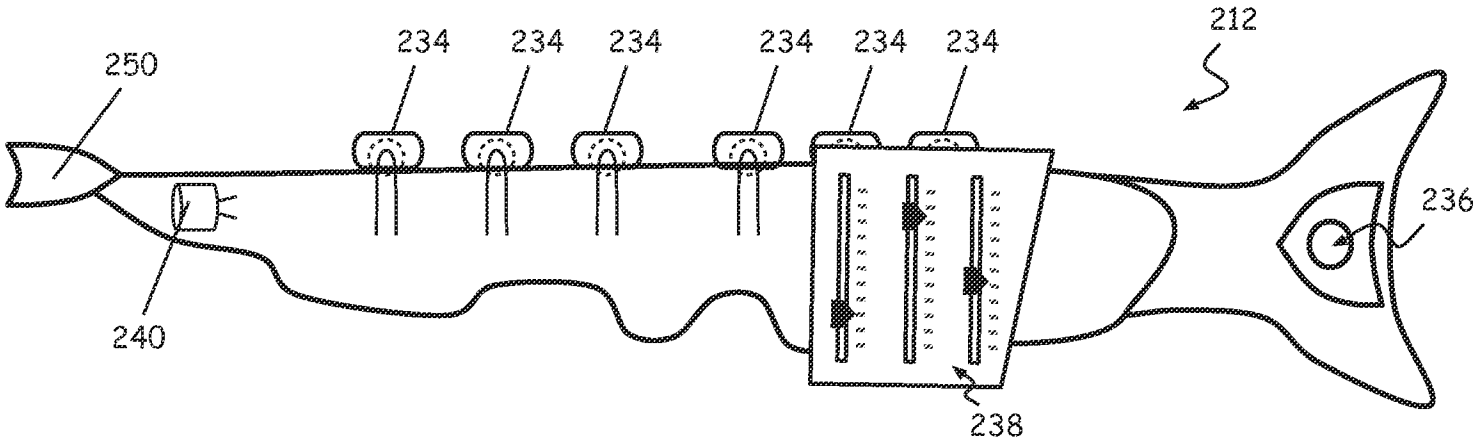
FIG. 3 is a plan view of an embodiment of an electronic wind instrument according to the present disclosure.

FIG. 3 is a plan view of an embodiment of an electronic wind instrument 212 according to the present disclosure. The wind instrument 212 includes a plurality of touch sensors 234, a proximity sensor 236, adjustment elements 238, and a microphone 240. The user blows into the mouthpiece 250 of the wind instrument 212, and the microphone 240 senses the intensity of the user's breath. An internal breath circuit (e.g., breath circuit 42 in FIG. 1) processes the signals from the microphone 240 to control the velocity of the notes generated by the synthesizer 16. The user plays notes by touching one or more of the touch sensors 234, controls the key of the notes (i.e., transposes the notes) played by the touch sensors 234 by moving a hand or finger relative to the proximity sensor 236. The adjustment elements 238 can be used to control the quality of the sounds (e.g., output volume and vibrato) played by the instrument, for example. In some embodiments, the touch sensors 234 each include a light emitting diode (LED) that is activated when the user touches the associated touch sensor 234. The MIDI 14 and synthesizer 16 are provided signals by the wind instrument 212 to generate sounds to imitate a conventional wind instrument (e.g., clarinet).

Figure 4:
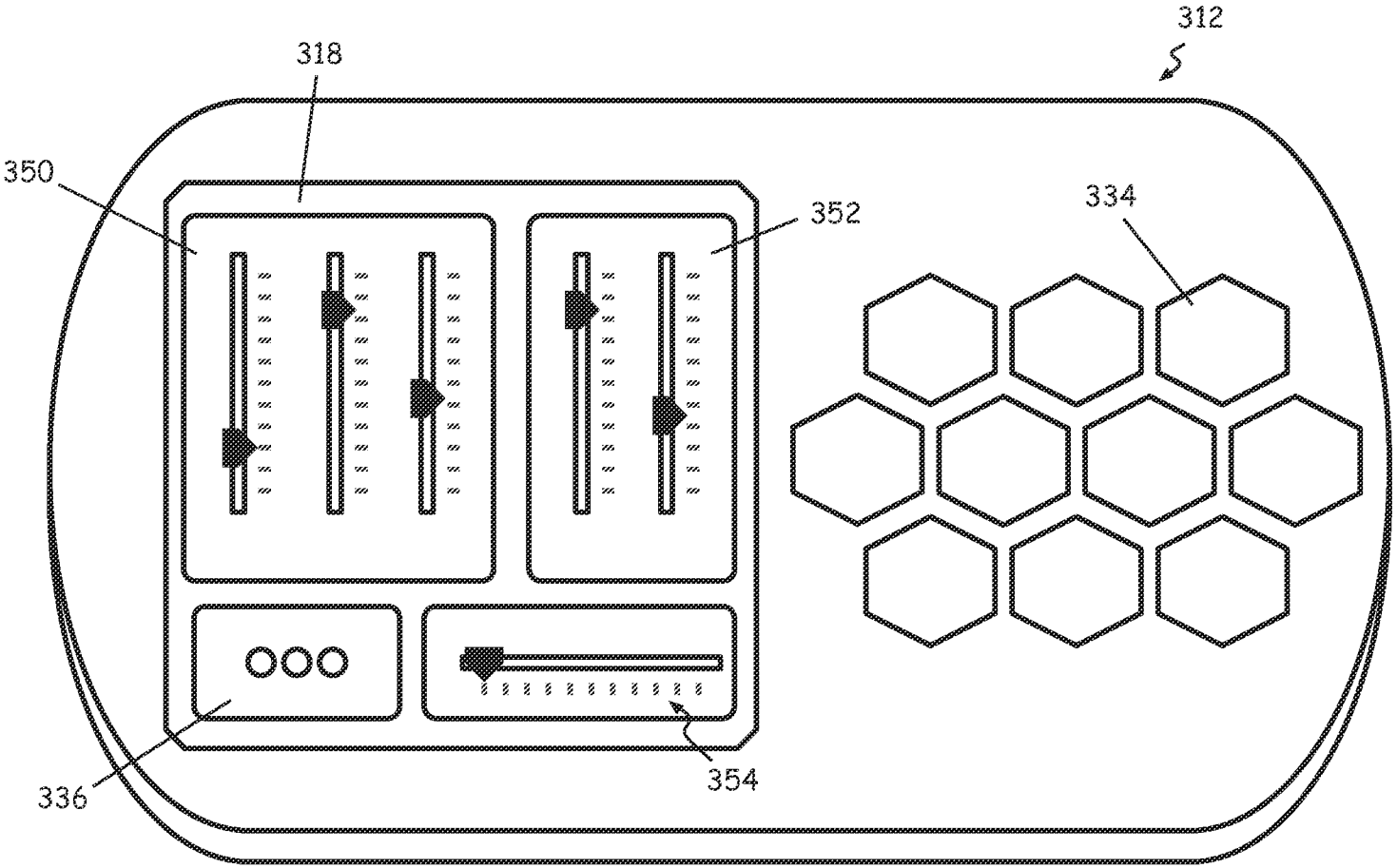
FIG. 4 is a plan view of an embodiment of an electronic keyboard according to the present disclosure.

FIG. 4 is a plan view of an embodiment of an electronic keyboard 312 according to the present disclosure. The keyboard 312 includes synthesizer control panel 318, touch sensors 334, and proximity sensor 336. In the embodiment shown, the synthesizer control panel 318 includes voltage controlled oscillator (VCO) module 350, voltage controlled filter (VCF) module 352, and voltage controlled amplifier (VCA) module 354. The touch sensors 334 are used to play notes and combinations of notes, and the proximity sensor 336 can be used to transpose the notes played by the touch sensors 334. In the embodiment shown, the touch sensors 334 are hexagonal in shape and arranged in a "honeycomb" matrix pattern. This allows the touch sensors 334 to be placed in close proximity to each other, allowing the user to touch multiple touch sensors 334 simultaneously. In this event, the keyboard 312 can be programmed to play the individual notes associated with each touch sensor 334 simultaneously (e.g., a two or three note chord), or a different note or tone can be assigned to different combinations of touch sensors 334. The information from the synthesizer control panel 318 can be used to control the characteristics of the sound generated by the MIDI 14 and synthesizer 16 based on the status of the touch sensors 334 and proximity sensor 336.

Figure 5:
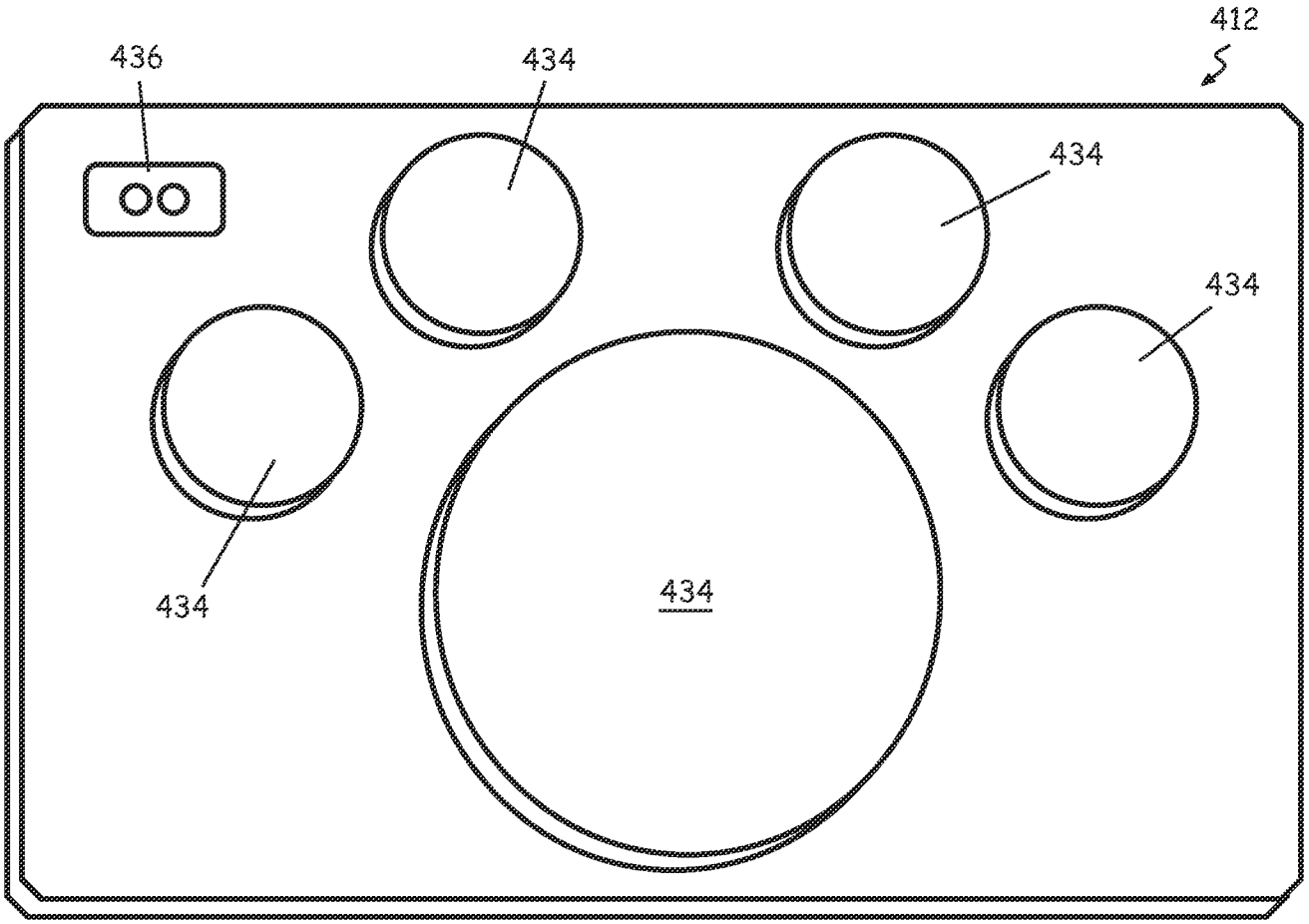
FIG. 5 is a plan view of an embodiment of an electronic drum kit according to the present disclosure.

FIG. 5 is a plan view of an embodiment of an electronic drum kit 412 according to the present disclosure. The electronic drum kit 412 includes a plurality of touch sensors 434 and a proximity sensor 436. The plurality of touch sensors 434 can each be associated with a different type of percussion instrument (e.g., snare drum, kick drum, tom-tom, crash cymbal, high hat, etc.). In some embodiments, the user can change types of percussion instruments associated with each of the touch sensors 434 by moving his or her hand or finger to different distances from the proximity sensor 436. The MIDI 14 and synthesizer 16 can use the signals generated by the drum kit 412 to generate associated audio sounds on the audio transducer 20.

Various modifications and additions can be made to the exemplary embodiments discussed without departing from the scope of the present invention. For example, while the embodiments described above refer to particular features, the scope of this invention also includes embodiments having different combinations of features and embodiments that do not include all of the above described features.

I claim:

1. An electronic musical instrument comprising:

a plurality of touch sensors each configured to generate an electrical signal representative of a musical note in response to being touched by a user;

one or more proximity sensors each configured to generate a user proximity signal based on a distance between the user and the sensor;

a controller configured to transpose the musical note associated with each touch sensor based on the user proximity signals from the one or more proximity sensors, the controller further configured to generate electrical signals representative of sound based on the electrical signals from the plurality of touch sensors; and one or more transducers configured to generate sound based on the electrical signals generated by the controller.

2. The electronic musical instrument of claim 1, wherein the plurality of touch sensors are configured to generate an electrical signal representative of a musical pitch or chord in response to two or more of the plurality of touch sensors being touched simultaneously.

3. The electronic musical instrument of claim 1, wherein the plurality of touch sensors are arranged in a honeycomb matrix on a body of the electronic musical instrument.

4. The electronic musical instrument of claim 1, wherein the one or more proximity sensors comprise optical sensors.

5. The electronic musical instrument of claim 1, and further comprising a synthesizer control panel.

6. The electronic musical instrument of claim 1, and further comprising:

a display configured to identify the musical key based on signals from the one or more proximity sensors.

7. The electronic musical instrument of claim 1, and further comprising:

a microphone configured to generate electrical signals representative of user breath strength, wherein the controller is configured to control an amplitude of the electrical signals representative of sound based on the electrical signals representative of user breath strength.

8. The electronic musical instrument of claim 1, and further comprising a communications port connected to the controller, the communications port configured to connect the controller to an external device.

9. The electronic musical instrument of claim 1, wherein the electronic musical instrument is configured as a guitar, wind instrument, keyboard, lute, or drum.

10. An electronic musical system comprising:

an electronic musical instrument including a plurality of touch sensors each configured to generate an electrical signal representative of a musical note in response to being touched by a user and one or more proximity sensors each configured to generate a user proximity signal based on a distance between the user and the sensor, the electronic musical instrument further including a controller configured to transpose the musical note associated with each touch sensor based on the user proximity signals from the one or more proximity sensors and generate electrical signals representative of sound based on the electrical signals from the plurality of touch sensors;

one or more transducers configured to generate sound based on the electrical signals generated by the controller; and a computer coupled to the controller, the computer comprises a digital audio workstation configured to provide a graphical user interface to facilitate recording, playback, and editing of music from the electronic musical instrument.

11. The electronic musical system of claim 10, and further comprising:

a musical instrument digital interface (MIDI) connected to the controller and configured to interpret the electrical signals representative of sound; and a synthesizer configured to generate input signals to the one or more transducers based on the electrical signals interpreted by the MIDI.

12. The electronic musical system of claim 11, and further comprising:

a synthesizer control panel configured to control settings of the synthesizer.

13. The electronic musical system of claim 10, wherein each of the touch sensors and proximity sensors is connected to a MIDI controller.

14. The electronic musical system of claim 10, and further comprising:

a device hub coupled between the controller and computer, wherein the device hub is configured to couple a plurality of electronic musical instruments to the computer.

15. The electronic musical system of claim 10, wherein the plurality of touch sensors are configured to generate an electrical signal representative of a musical pitch or chord in response to two or more of the plurality of touch sensors being touched simultaneously.

16. The electronic musical system of claim 10, wherein the plurality of touch sensors are arranged in a honeycomb matrix on a body of the electronic musical instrument.

17. The electronic musical system of claim 10, wherein the one or more proximity sensors comprise optical sensors.

18. The electronic musical system of claim 10, and further comprising:

a display configured to identify the musical key based on signals from the one or more proximity sensors.

19. The electronic musical system of claim 10, and further comprising:

a microphone configured to generate electrical signals representative of user breath strength, wherein the controller is configured to control an amplitude of the electrical signals representative of sound based on the electrical signals representative of user breath strength.

20. An electronic musical instrument comprising:

a plurality of touch sensors each configured to generate an electrical signal in response to being touched by a user;

a proximity sensor configured to generate a user proximity signal based on a distance between the user and the sensor; and a controller configured to transpose a musical note associated with each touch sensor based on the user proximity signal, the controller further configured to generate output electrical signals representative of sound based on the electrical signals from the plurality of touch sensors.

* * * * *